US011384616B1

(12) United States Patent
Ruttley et al.

(10) Patent No.: US 11,384,616 B1
(45) **Date of Patent: *Jul. 12, 2022**

(54) MULTI-STRING SECTION MILL

(71) Applicant: Dynasty Energy Services, LLC, Lafayette, LA (US)

(72) Inventors: David J. Ruttley, Marrero, LA (US); Gerald J. Cronley, Gretna, LA (US)

(73) Assignee: Dynasty Energy Services, LLC, Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/541,078

(22) Filed: Dec. 2, 2021

Related U.S. Application Data

(63) Continuation of application No. 17/232,657, filed on Apr. 16, 2021.

(51) Int. Cl.
*E21B 29/00* (2006.01)
*E21B 17/10* (2006.01)
*E21B 23/04* (2006.01)

(52) U.S. Cl.
CPC ..... *E21B 29/005* (2013.01); *E21B 17/1021* (2013.01); *E21B 23/042* (2020.05); *E21B 23/0412* (2020.05)

(58) Field of Classification Search
CPC ... E21B 10/322; E21B 29/005; E21B 17/1021
See application file for complete search history.

(56) References Cited

U.S. PATENT DOCUMENTS

| | | | | |
|---|---|---|---|---|
| 7,063,155 | B2 | 6/2006 | Ruttley | |
| 7,909,100 | B2 | 3/2011 | Bryant, Jr. et al. | |
| 9,695,660 | B2 | 7/2017 | Ruttley | |
| 10,240,418 | B2 | 3/2019 | Ruttley | |
| 10,344,548 | B2 | 7/2019 | Ruttley et al. | |
| 10,605,025 | B2 | 3/2020 | Ruttley | |
| 2011/0220357 | A1* | 9/2011 | Segura | E21B 29/002 166/298 |

* cited by examiner

*Primary Examiner* — Robert E Fuller
*Assistant Examiner* — Lamia Quaim

(57) ABSTRACT

A multi-string section milling tool has a longitudinally extending tubular body with mill carriers carrying hardened cutters that pivotally extend from a mill window in the tubular body by upward movement of a drive plunger. A downwardly biased piston mounted to the upper end of a flow tube is slidably inserted through a stationary thimble below the piston. The lower end of the flow tube is attached to a drive plunger which is pivotally attached to drive yoke links pivotally attached the mill carriers. The piston and thimble creates a pressure chamber in the milling tool. Fluid pressure in the pressure chamber moves the piston, flow tube and drive plunger upward to pivotally extend the drive yoke links and mill carriers radially outward through the mill window. Cessation of fluid pressure in the pressure chamber retracts the mill carriers.

16 Claims, 18 Drawing Sheets

MULTI-STRING SECTION MILL

PRIORITY

This application claims priority to United States provisional patent application Ser. No. 63/012,674 entitled "Multi-String Milling Tool" filed on Apr. 20, 2020, the entire content of which is thereby incorporated by reference.

FIELD OF INVENTION

This invention relates to the field of sub-surface wellbore tools and equipment and, more particularly, to an apparatus for severing or cutting sections through multiple strings of wellbore casing or similar tubulars disposed in a wellbore.

BACKGROUND OF THE INVENTION

Section milling tools are often utilized to cut through sections of wellbore tubulars such as strings of casing pipe or other oilfield tubulars disposed in a wellbore for drilling and production of oil and gas wells. These strings may be concentrically placed in the wellbore or they may be placed eccentrically placed such that the strings are offset from one another in the wellbore. A variety of section milling tools has produced to perform such milling operations. Typically, such section milling tools are attached to a pipe string such as a drill pipe string or coiled tubing string which is run or placed downhole in a wellbore through one of the tubulars to be milled to a location where a milling operation is to be conducted. Generally, mining tools employ one or more retractable cutters that extend radially outward from the milling tool to engage the area of the casing or other tubing which is to be milled. Surface equipment such as a rotary table, a power swivel or the like is utilized to rotate the milling tool and its associated cutters to facilitate the cutting process. The cuttings from the milling operation are then circulated out of the wellbore by means of circulating wellbore fluid.

Problems associated with such milling tools, which reduce milling efficiency, increase wear and tear on the milling tool, and increase the cost of milling operations, include wobbling, oscillation, and vibration of the cutters during rotation of the milling tool, the failure of the extendable cutters to fully extend from the milling tool, inadequate radial force on the cutters resulting in incomplete or inadequate cuts in the tubular being milled, and excessive wear on the cutters and the cutter drive system that prevents efficient cutting of multiple strings of tubulars. The present invention is designed to address the foregoing problems in order to reduce tool vibration, cutter wobbling, and increase the reliability of cutter extension from the section milling tool, and reduce milling costs.

SUMMARY OF THE INVENTION

The proposed invention provides a new section milling tool for milling a window, a cutout, or a cutoff in multiple strings of oilfield tubing or casing. The section milling tool has a longitudinally extending tubular mill body threadedly attached to a top sub which is attached to a work string. The mill body of the section milling tool has a central bore and is provided with retractable mill carriers having an army of cutters that re deployed radially inward and outward from the central bore of the tubular mill body through a mill window by a translatable drive plunger at the lower end of the mill body.

The section milling tool has a translatable piston and a stationary thimble sealing the central bore of the tubular mill body to create a fluid pressure chamber. The piston has upper and lower elongated stems in fluid communication with the central bore of the milling tool. A coiled compression spring may be placed around the upper piston stem between the piston and the top sub to bias the piston downward to a downhole position away front the top sub. The lower piston stem is inserted through a central bore in the thimble and attached in fluid communication to a flow tube. The translatable drive plunger is attached to the lower downhole end of the flow tube below the thimble. The mill carriers are mounted between upper follower links pivotally attached to the mill body and low drive yoke links pivotally attached to the drive plunger.

Fluid circulating through the work string enters the tubular mill body and the flow tube. This circulating fluid flows through the flow tube and enters the fluid chamber through fluid ports in the lower piston stem. Changes in the pressure of the fluid in the fluid chamber moves the piston and attached flow tube upward and downward with respect to the thimble as the lower piston stem slides through the central bore of the thimble and, correspondingly, moves the drive plunger upward and downward.

Upward uphole movement of the piston and attached flow tube and the corresponding upward movement of the drive plunger will pivot the lower drive yoke links radially outward, and correspondingly the upper follower links radially outward, to mow the pivotally attached mill carriers radially outward through a mill window in the mill body. The radially outward movement of the mill carriers from the mill window will engage the cutters with the inner wall of a casing in which the work string and milling tool is deployed. Milling is conducted by rotation of the work string. An expansion limiter may be provided to limit the radial outward position of the mill carriers and corresponding cutters during use.

Figure 1:
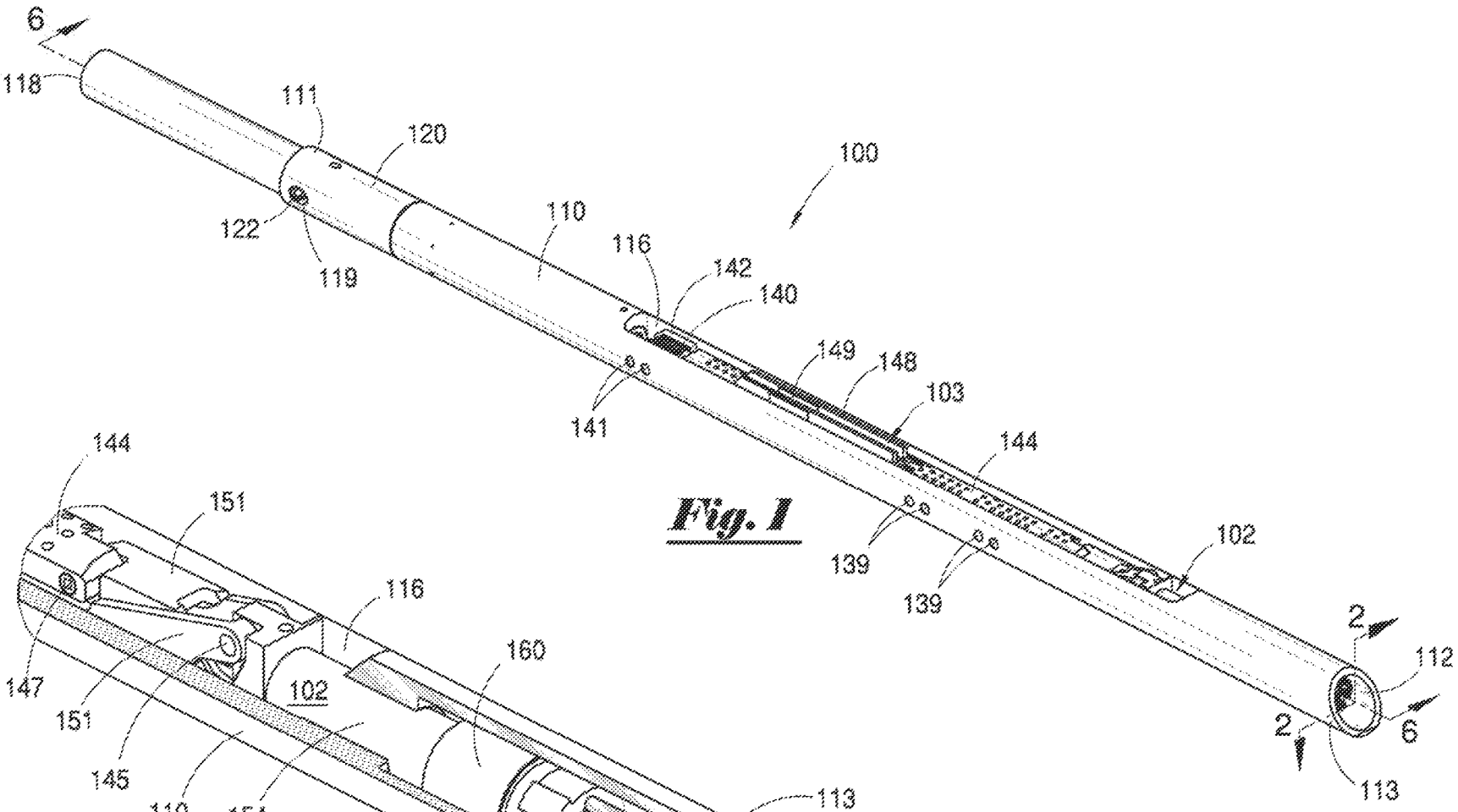
FIG. 1 is a longitudinal view of an assembled section milling tool of Applicants' Invention with the milling assembly in its retracted position.
Figure 2:
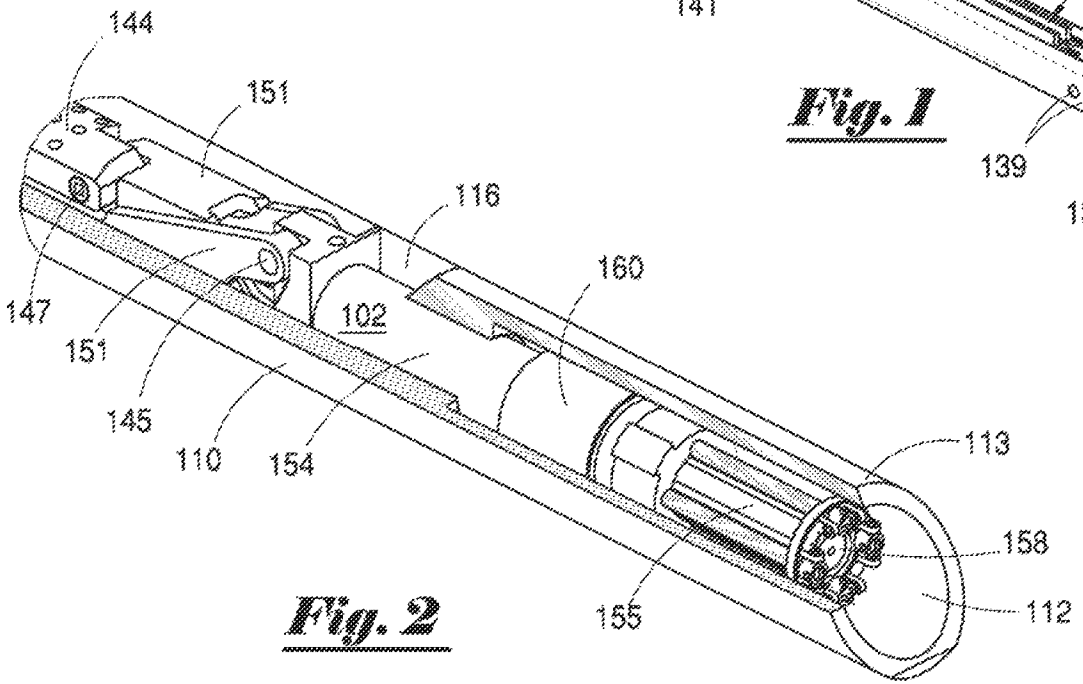
FIG. 2 is a partial longitudinal cross-section view of the section milling tool shown in FIG. 1 showing the dive plunger in its retracted or downward position.
Figure 3:
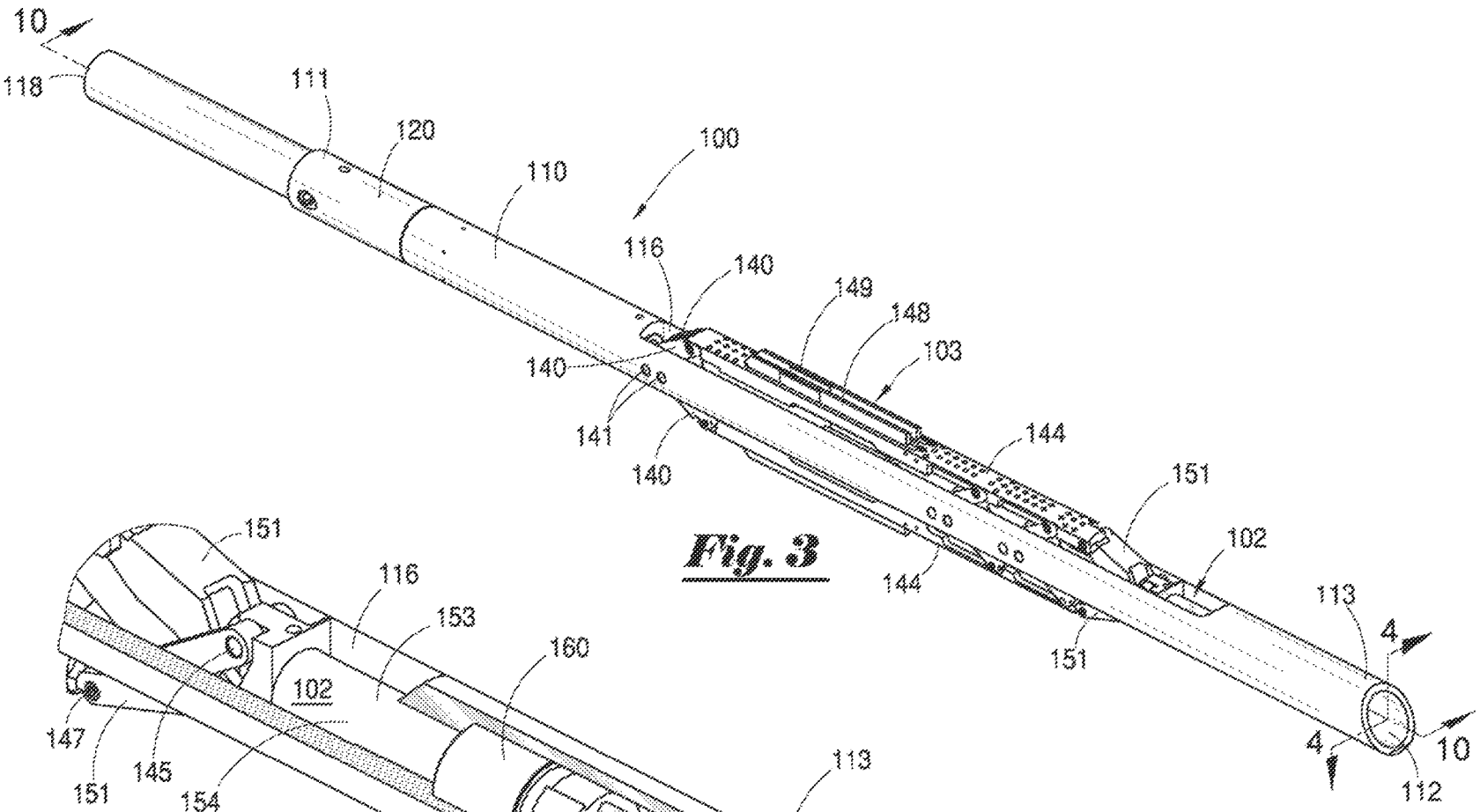
FIG. 3 is a longitudinal view of an assembled section milling tool of Applicants' invention with the milling assembly in its extended position.
Figure 4:
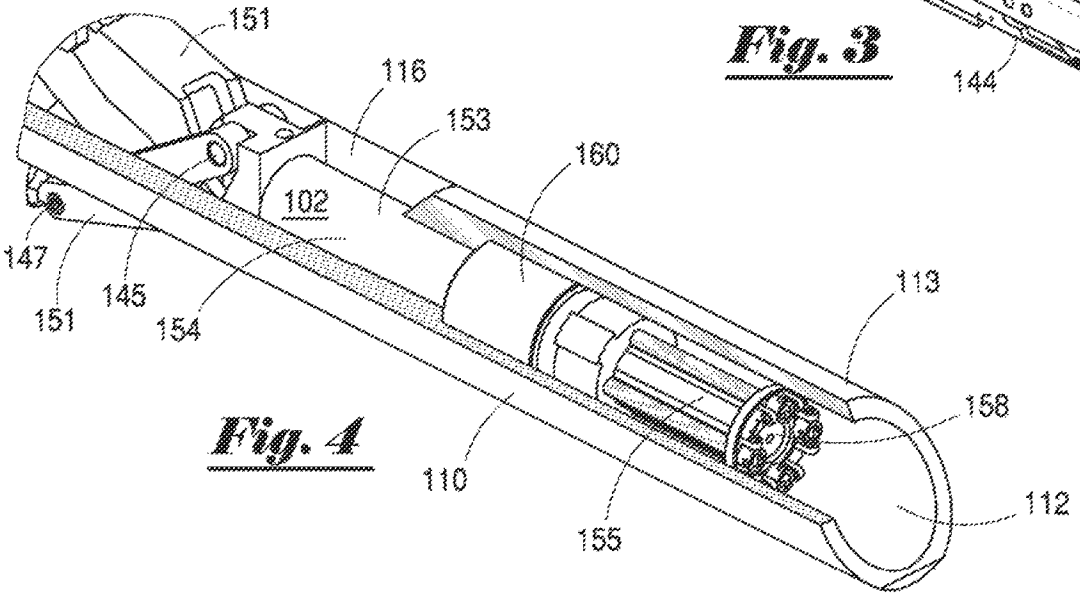
FIG. 4 is a partial longitudinal cross-section view of the section milling tool shown in FIG. 1 showing the drive plunger assembly in its extended or upward position.
Figure 5:
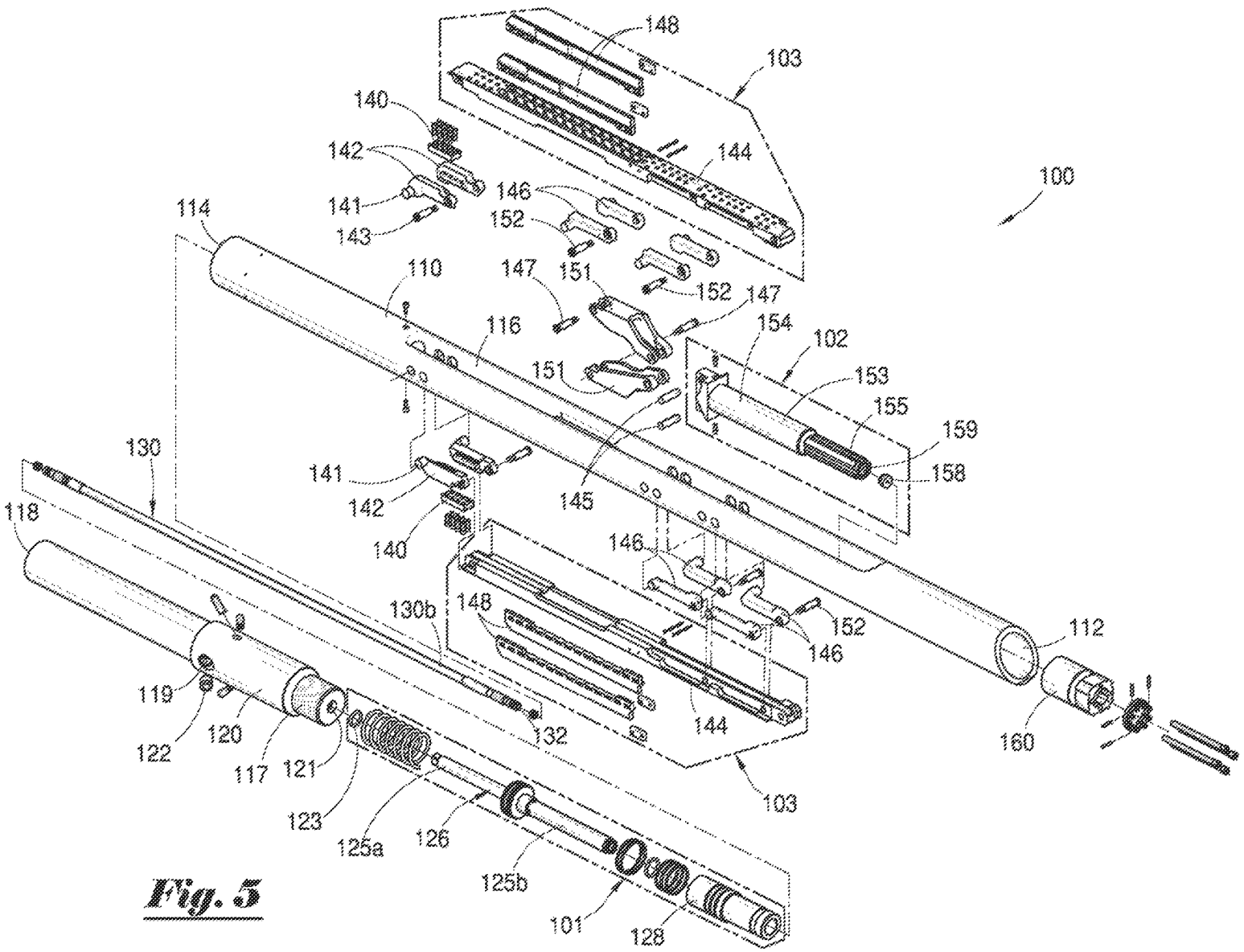
FIG. 5 is an exploded view of the section milling tool shown in FIG. 1 illustrating the assembly of its various components.

These drawings may omit features that are well established in the art and do not bear upon points of novelty in the interest of descriptive clarity. Such omitted features may include threaded junctures, weld lines, sealing elements, O-rings, pins and brazed junctures.

DESCRIPTION OF THE EMBODIMENTS

Referring now to de drawings, particularly FIGS. 1-5, 6A and 6B, the section milling tool 100 of Applicants' invention has an upper uphole end 111, a downhole lower end 113, a longitudinally extending tubular mill body 310 having a central bore 112, and a top sub 120 that is attached to a work string 200. The tubular mill body 110 of the section milling tool 100 has longitudinally extending centrally located mill windows 116 that open into the central bore 112. Positioned within the central bore 112 of section milling tool 100 are an upper piston assembly 101 and a lower plunger assembly 102. A mill assembly 103 is positioned adjacent the mill windows 116 between the piston assembly 101 and the plunger assembly 102.

Section milling tool 100 also has a tubular top sub 120 headedly connected to mill body 110 by a top sub pin connection 117 and a mill body box connection 114. The top sub 20 is threadedly connected to mill body 110 by a top sub pin connection 117 and a mill body box connection 114. The top sub 120 has an upper box connection 118 for attachment to a pin connection 202 at the lower downhole end of the work string 200. Top sub 120 also has ports 119 that re in fluid communication with its central bore 121. The ports 119 are drilled and tapped to receive nozzles or fluid jets 122. The nozzles or fluid jets 122 allow for pressure adjustments within the section milling tool 100 to enhance its function and facilitate mill swarf removal during milling. The ports 119 in the upper top sub 120 may also be drilled and tapped to receive a plunger or flapper-type float valve. The plunger or flapper-type float militates against the effect of U-tubing to prevent debris from entering the mitt body 110 when pumping ceases or when a connection is required.

Figure 6A:
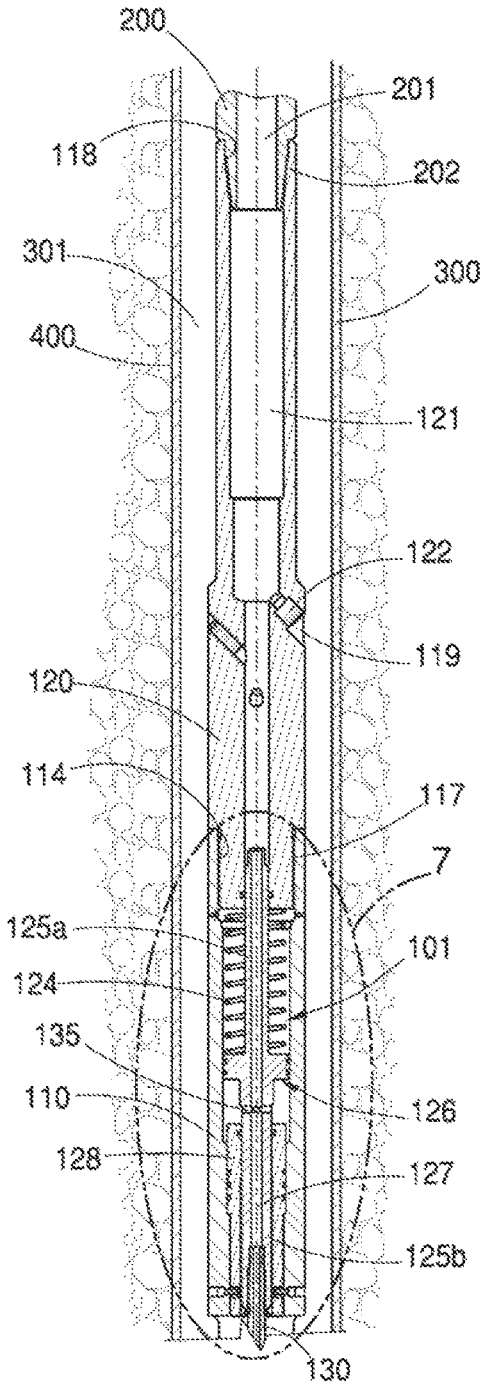
FIGS. 6A and 6B are longitudinal cross-section views of the section milling tool shown in FIG. 1 positioned in a wellbore.
Figure 6B:
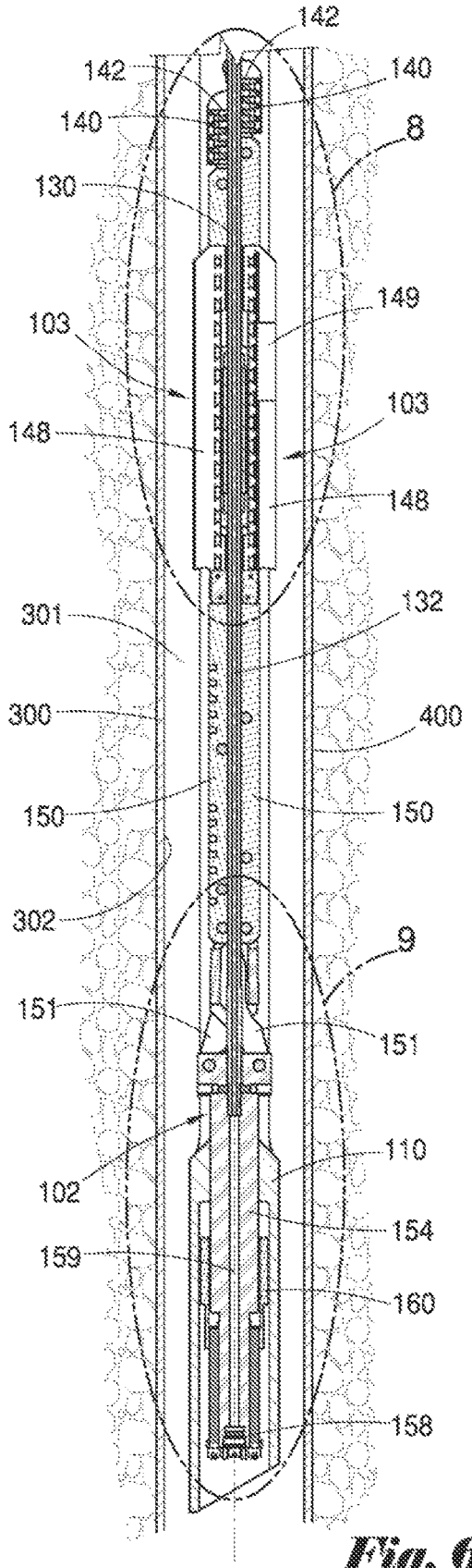
Figure 7:
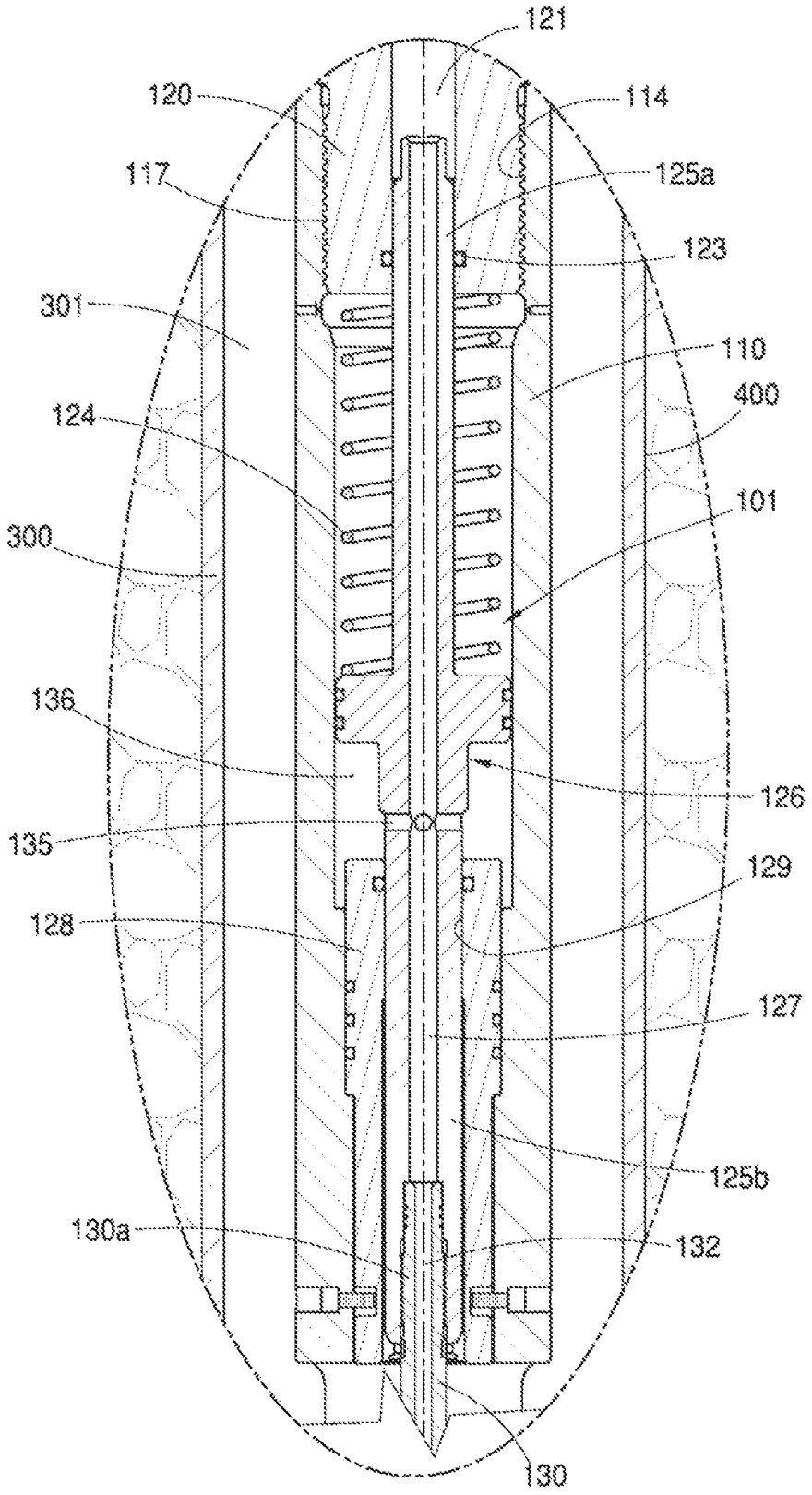
FIG. 7 is an enlarged cross-section view of the piston assembly of the section milling tool designated as detail 7 in FIG. 6A.

FIGS. 6A and 6B show longitudinal cross-section views of the section milling tool 100 and its components attached to the end of the work string 200 and placed within the central bore 301 of a casing or liner pipe string 300 lining a wellbore 400. As shown in FIG. 7, a detail view from FIG. 6A, the piston assembly 101 of section milling tool 100 is positioned within mill body 110 below the tubular top sub 120 with the central bore 121 of the top sub 120 in fluid communication with the central bore 201 of the work string 200.

The piston assembly 101 has a slidably positionable drive piston 126 upward from a stationary thimble 122. The drive piston 126 has a longitudinally extending upper piton stem 125*a* and a lower piston stem 125*b*. A central piston bore 127 in fluid communication with the central bore 121 of the top sub 120 extends through the drive piston 126 and piston stems 125*a* and 125*b*. The lower piston stem 125*b* extends through the polished thimble bore 129 of a stationary thimble 128 that is positioned a desired distance below the drive piston 126 within the central bore 112 of the tubular mill body 110 to seal the central bore 112. The lower end of the central bore 121 in the bottom pin connection 117 of the top sub 120 may be fitted with an O-ring 123 where it engages the piston stem 125*a* to maintain the required fluid movements and pressures during activation of the milling tool 100.

The piston assembly 101 may also have a coiled compression release spring 124 located around the upper piston stem 125*a* between the top sub 120 and the drive piston 126. The compression string 124 serves to bias the drive piston downward toward the stationary thimble 128. The space between the drive piston 126 and the stationary thimble 128 creates a fluid pressure chamber 136 for movement of the drive piston 126. The lower piston stem 125*b* has fluid ports 135 that allow fluid circulating through the lower piston stem 125*b* from the central bore 121 of the top sub 120 to enter the fluid pressure chamber 136. A longitudinally extending flow tube 130 having a central bore 132*s* threadedly attached at its upper end 130*a* to the lower piston stem 125*b*.

Figure 9:
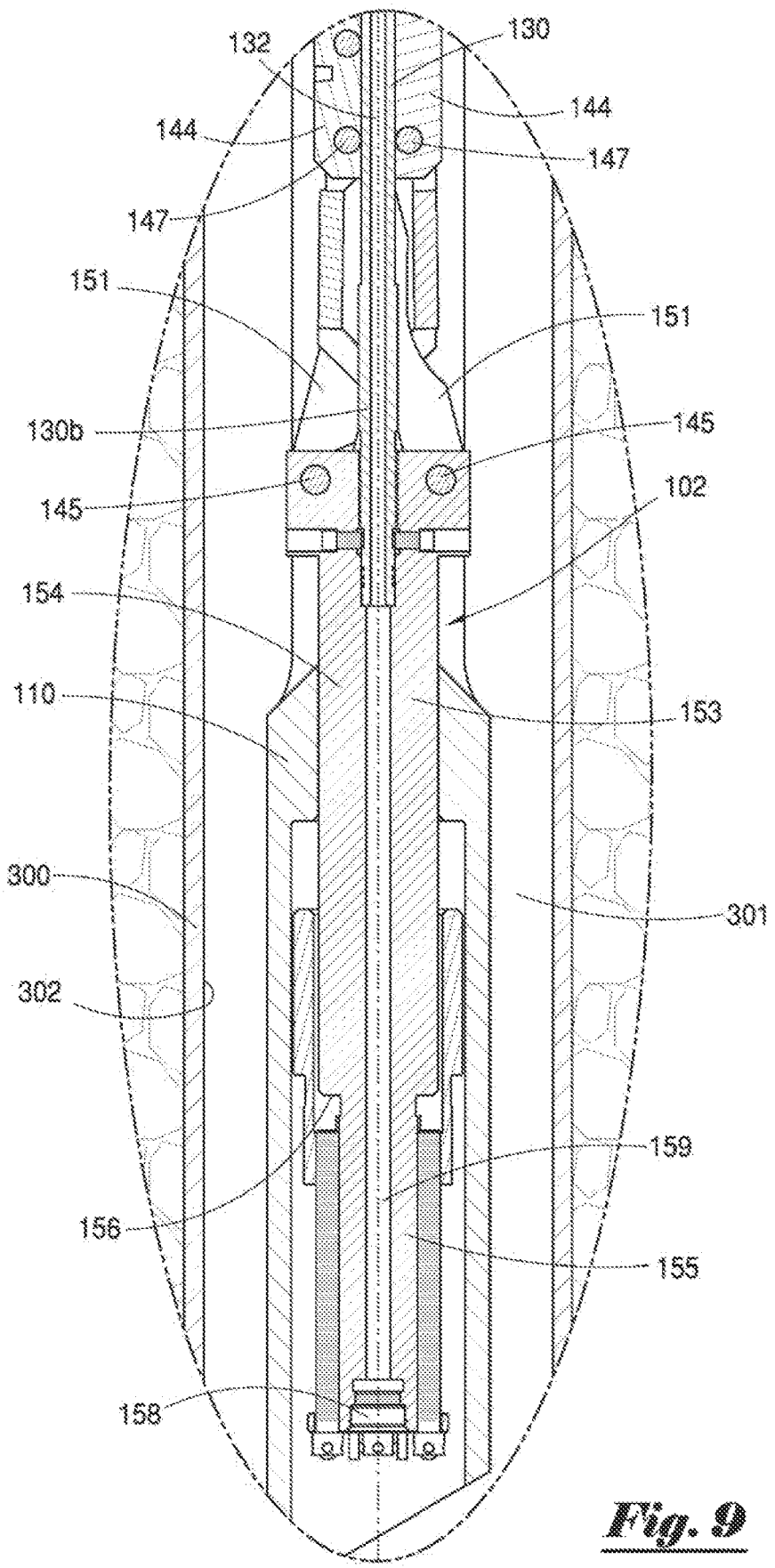
FIG. 9 is an enlarged cross-section view of the plunger assembly of the section milling tool designated as detail 9 in FIG. 6B.

Flow tube 130 extends through the central bore 112 of the mill body 110 to engage with the plunger assembly 102 shown in FIG. 9, a detail view from FIG. 6B. The plunger assembly 102 has a drive plunger 154 slidably positioned within the central bore 112 of the mill body 110. The drive plunger 154 has an elongated cylinder upper body section 153 that transitions to a lower body section 155 to create a shoulder 156, and a central bore 159. The upper body section 153 of drive plunger 154 is threadedly attached to the longitudinally downward lower end 130*b* of the flow tube 130 with time flow tube central bore 132 in fluid communication with the central bore 159 of the drive plunger 154.

The flow tube 130 allows fluid from the central bore 201 of the work string 200 to circulate through the central bore 121 of the top sub 120, through the central bore 127 of the drive piston 126, through flow tube central bore 132 of flow tube 130, and through the central bore 159 of the drive plunger 154 of the section milling tool 100. A flow-limiter 158 such as a fluid jet or nozzle is provided in the central bore 159 at the end of the lower body section 155 of the drive plunger 154 to allow for pressure adjustment within de flow tube 130.

The fluid ports 135 in the lower piston stem 125*b* allow fluid circulating through the central piston bore 127 to the flow tube 130 from the central bore 121 of the top sub 120 to enter the fluid pressure chamber 136. Variations in fluid pressure within the fluid pressure chamber 136 will move the drive piston 126 upward and downward with respect to the stationary thimble 128. The attachment of the flow tube 130 between the drive piston 126 and the drive plunger 154 allows the drive plunger 154 to move upward and downward within the central bore 112 of the mill body 110 of the section milling tool 100 in response to upward and downward movement of the drive piston 126.

Pivotally mounted between the piston assembly 101 and the plunger assembly 102 is the mill assembly 103 shown as detail 8 in FIG. 6B. The mill assembly 103 of the section milling tool 100 is comprised of retractable mill carriers 144 that are deployed radially inward and outward from the tubular mill body 110 through mill windows 116. The mill carriers 144 have a longitudinal array of attached cutters 148. Each of the cutters 148 has a hardened cutting surface such as a carbide surface, a surface of polycrystalline diamond, or the like to facilitate milling through the wall of a pipe string 300 in which the section milling tool 100 is inserted.

Hardened stabilizer blades 149 may be provided and attached to the mill carriers 144 in conjunction with the cutters 148 to bear against the inner wall of a tubing segment in order stabilize the mill carriers 144 during the milling process. The cutters 148 and stabilizer blades may be provided as a unit or they may be provided individually and attached to the mill carriers 144. The stabilizer blades 149 are recessed from the hardened cutting surface of the cutters 148 and have a wider beating surface that serves to prevent damage to the wall of adjacent pipe strings such as the wall of an outer liner pipe string when inner liner pipe string 300 is being milled.

Each of the mill carriers 144 may also be provided with a stabilizer pad 150 surface that is preferably positioned below the cutters 148. The stabilizer pad 150 serves to assist in positioning mill carriers 144 at a desired location for milling through the interior wall 302 of liner pipe string 300. The stabilizer blade 149 and stabilizer pad 150 are coated with a hard metal or provided with hard metal bearing inserts to increase wear resistance when section milling.

The mill carriers 144 are pivotally mounted between upper follower links 142 and lower drive yoke links 151. The upper follower links 142 are attached to the mill carriers 144 by crown pins 143 and to the mill body 110 by studs 141. The lower drive yoke links ISI at pivotally connected to the drive plunger 154 by crown pins 145 and to the mill carrier 144 by stud pins 147. Intermediate follower links 146 are arrayed between the upper follower links 142 and the lower drive yoke links 151 and are pivotally mounted to the mill carriers 144 by crown pins 152 and to the mill body 110 by studs 139. The upward movement of drive plunger 154 pivots the lower drive yoke links 151 downward and outward on crown pins 145 and stud pins 147 to move the pivotally attached intermediate follower links 146 and upper follower links 142 upward and outward to deploy the pivotally attached mill carriers 144 radially outward tom the mill window 116 in the mill body 110.

Figure 13:
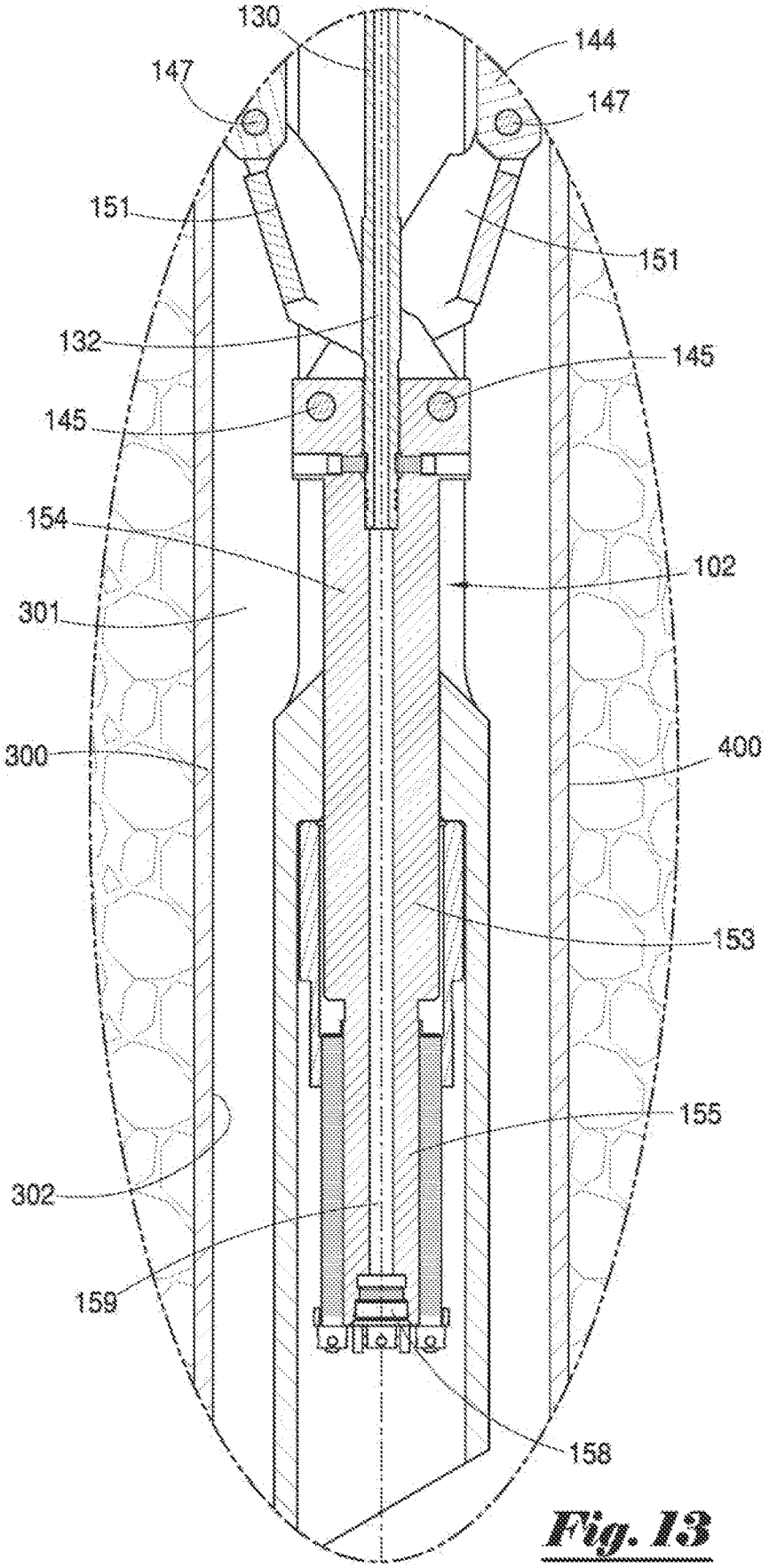
FIG. 13 is an enlarged cross-section view of the plunger assembly of the section milling tool designated as detail 13 in FIG. 10B.
Figure 14:
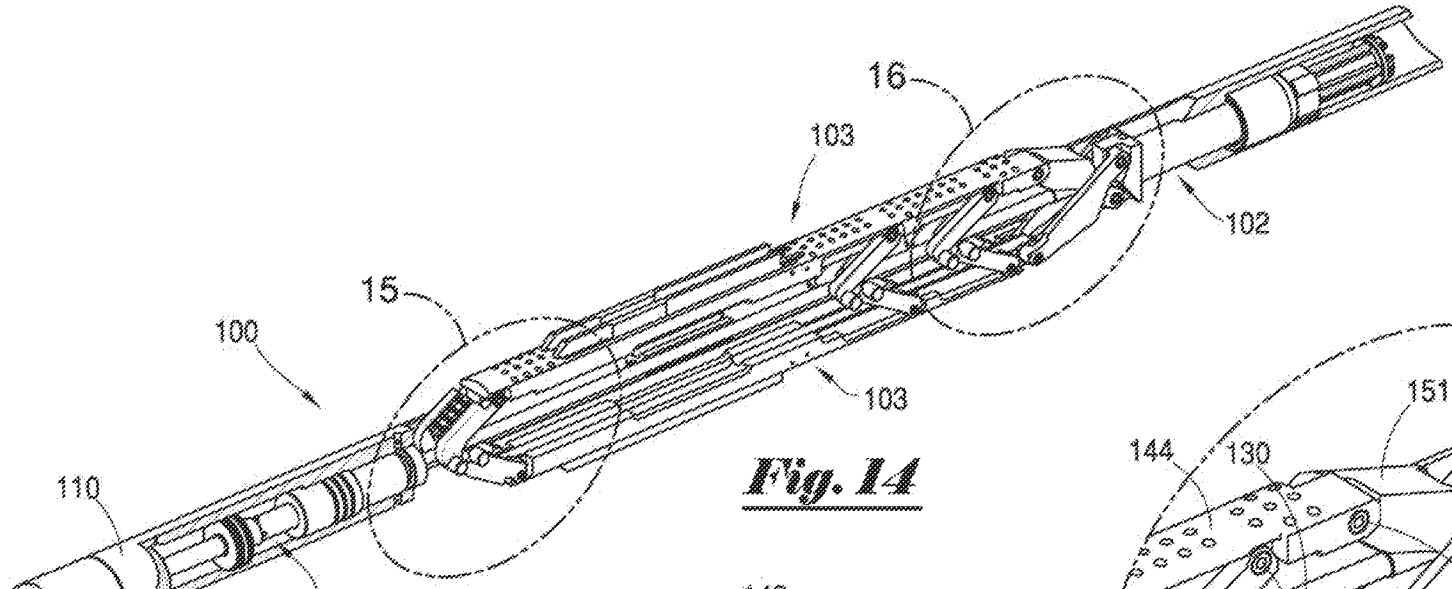
FIG. 14 is a partial longitudinal cutaway view of the section milling tool shown in FIG. 1 showing the piston assembly, the milling assembly, and the plunger assembly.

FIG. 14 shows a partial cutaway view of the section milling tool 100 of FIG. 1 displaying the relationship of the piston assembly 101, the milling assembly 102, and the plunger assembly 102. FIG. 13, designated as detail 15 in FIG. 14, shows the upper follower links 142 pivotally attached to the mill body 110 by studs 141 and to the mill carriers 144 by crown pins 143. Entry guides 140 with harden surfaces reinforce the upper follower links 142 as they pivot into and out of the mill body 110.

Figure 16:
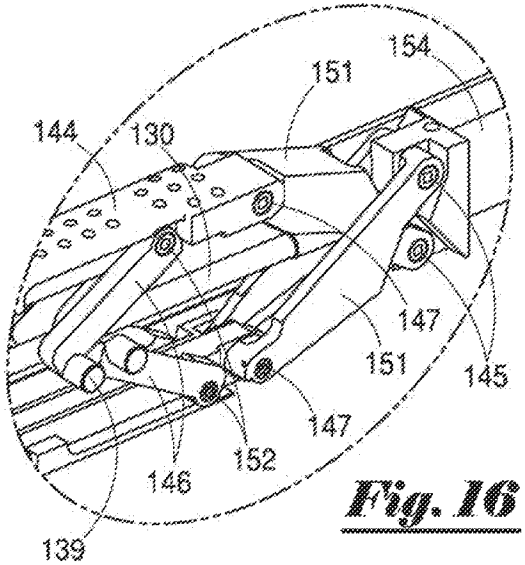
FIG. 16 is an enlarged view of the drive yoke links and follower links of the milling assembly of the section milling tool shown in FIG. 1 designated as detail 16 in FIG. 14.
Figure 15:
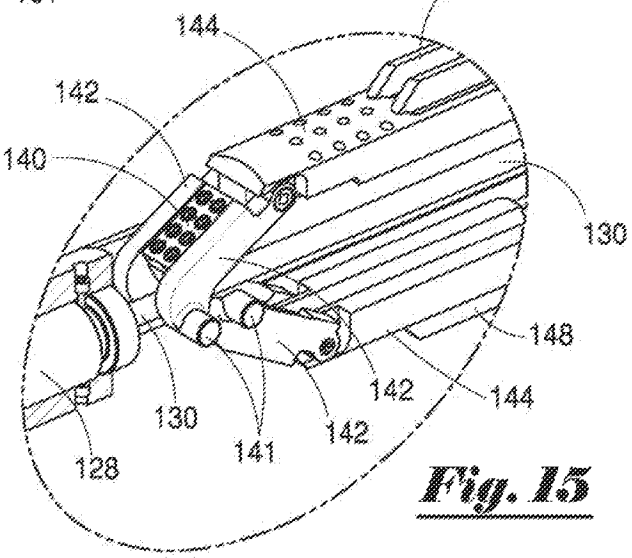
FIG. 15 is an enlarged view of the upper follower links of the milling assembly of the section milling tool shown in FIG. 1 designated as detail 15 in FIG. 14.

FIG. 16, designated as detail 16 in FIG. 14, shows the drive yoke links 151 pivotally attached to the mill carrier 144 by crown pins 145 and to the drive plunger 154 by stud pins 147. The intermediate follower links 146 are arrayed between the upper follower links 142 and the lower drive yoke links 151 and are pivotally attached to the mill body 110 by studs 139 and to the mill carriers 144 by crown pins 152.

Figure 17:
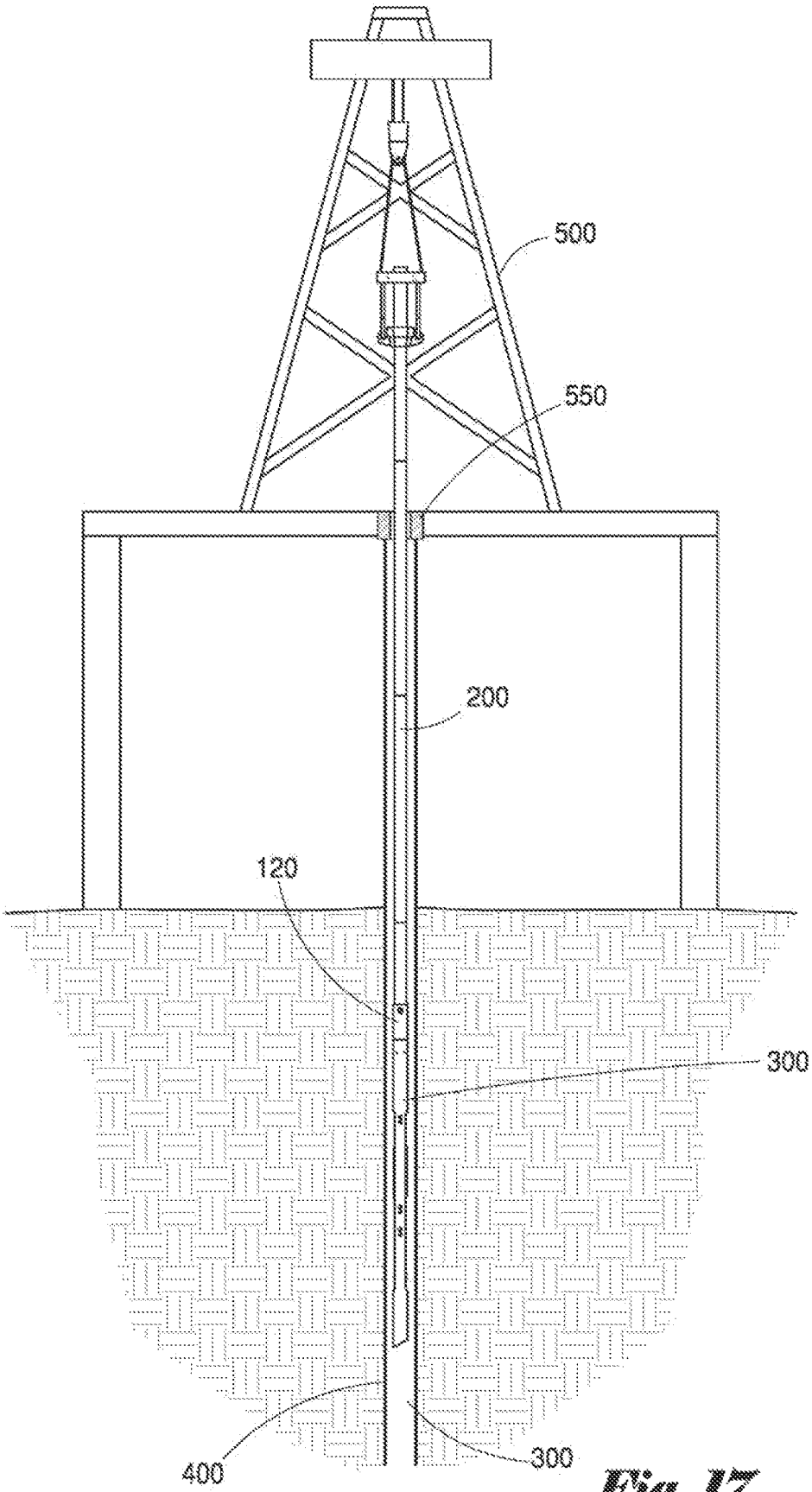
FIG. 17 is a schematic view of the section milling tool shown in FIG. 1 shown in place in a wellbore of an oil and as well.

For operation of the section milling tool 100, the pin connection 117 of the top sob 120 is connected to the mill body box connection 114 and the box connection 118 of the top sub 120 is connected to a pin connection 202 at the lower downhole end of the work string 200 as shown in FIG. 6A. The work string 200 and attached section milling tool 100, with the mill as assembly 103 in a retracted position as shown in FIG. 6B, is then inserted through the central bore 301 of the liner pip string 300 in a wellbore 400 of a drilling rig 500 to be milled as shown in FIG. 17.

Figure 10A:
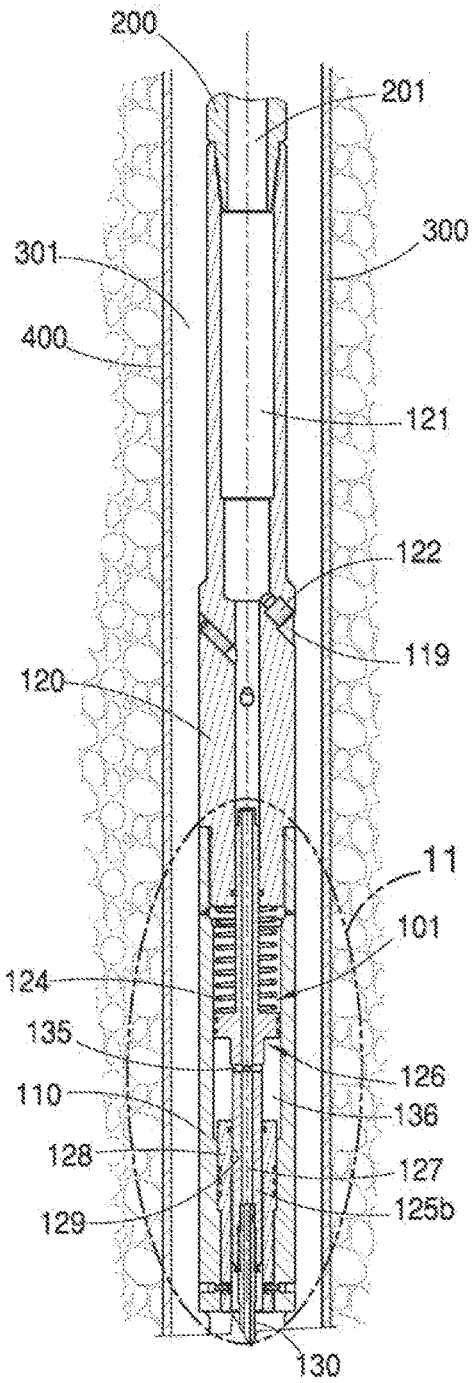
FIGS. 10A and 10B are longitudinal cross-section views of the section milling tool shown in FIG. 1 positioned in a wellbore showing the retractable mill carriers of the milling assembly deployed radially outward.
Figure 10B:
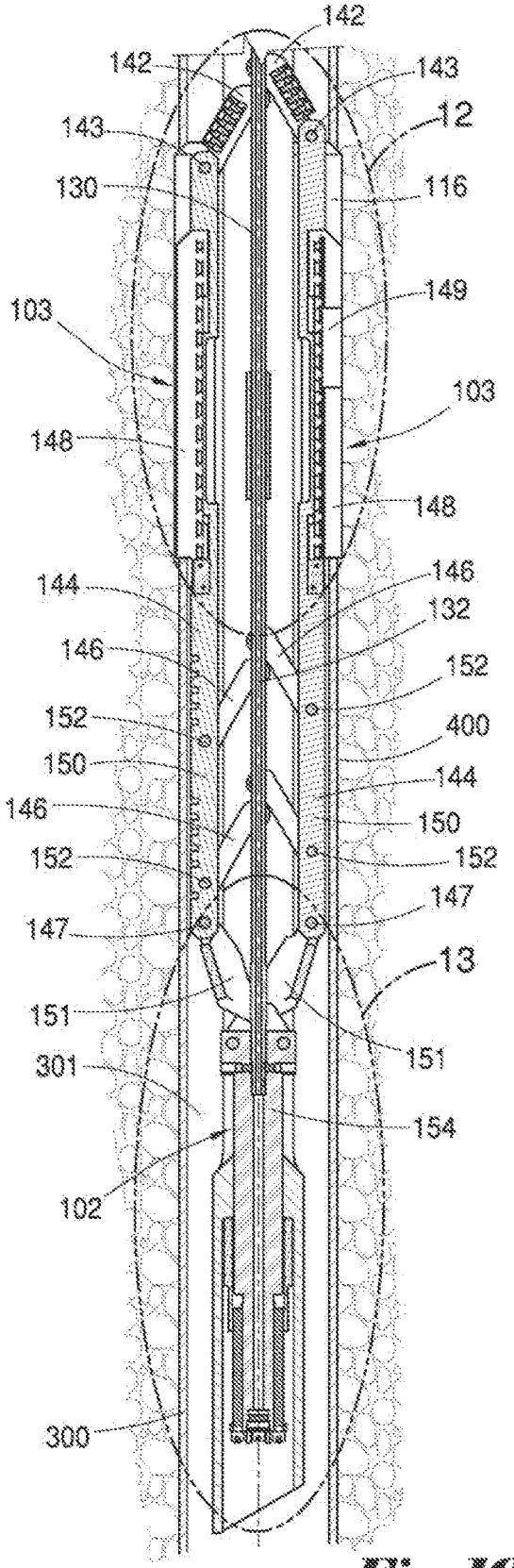
Figure 11:
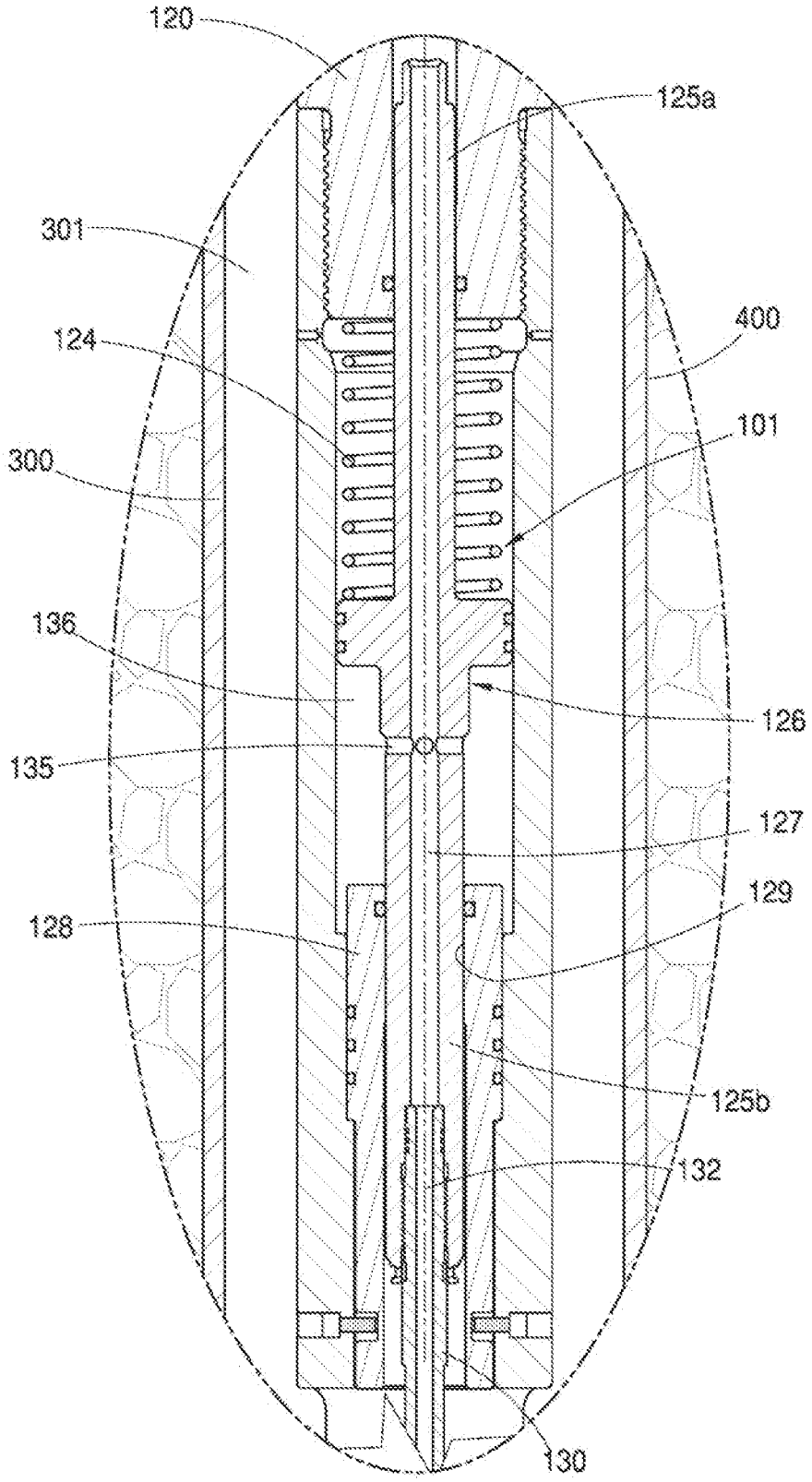
FIG. 11 is an enlarged cross-section view of the piston assembly of the section milling tool designated as detail 11 in FIG. 10A.

Referring now to FIG. 10A and FIG. 10B, fluid is pumped into the central bore 201 of the work string 200 to circulate though the central bore 121 of the top sub 120 to enter the central piston bore 127 and central bore 132 of flow tube 130. Fluid from the central bore 121 of the top sub 120 circulates through the central piston bore 127 to the low piston stem 125*b* and enters the fluid pressure chamber 136 between the drive piston and the stationary thimble 128 through fluid ports 135. Pressure created in the fluid pressure chamber 136 from the fluid entering through fluid ports 135 expands the fluid pressure chamber 136 and moves the drive piston 126 from the downwardly biased downhole position shown in FIG. 7 to an upward or uphole position to compress the release spring 124 as shown in FIG. 11.

The upward movement of the drive piston 126 in turn moves the attached flow tube 130 upward through the stationary thimble 128 and correspondingly moves the attached drive plunger 154 upward from the downwardly biased downhole positon shown in FIG. 9 to an upward uphole position as shown in FIG. 13. The upward movement of the attached drive plunger 154 will cause the pivotally mounted drive yoke links 151 of the mill carriers 144 to pivot downward and radially outward on crown pins 145 and stud pins 147 to move the mill carrier 144 radially outward from the mill body 110 through the mill window 116 as shown in FIG. 13. The upper follower link 142 and intermediate follow links 146 will pivot upward and radially outward to stabilize the mill carriers 144. A lateral support ring 131 may be provided within the central bore 112 of the mill body 110 to support the flow tube 130 as it moves in response to movement of the drive piston 126.

Figure 12:
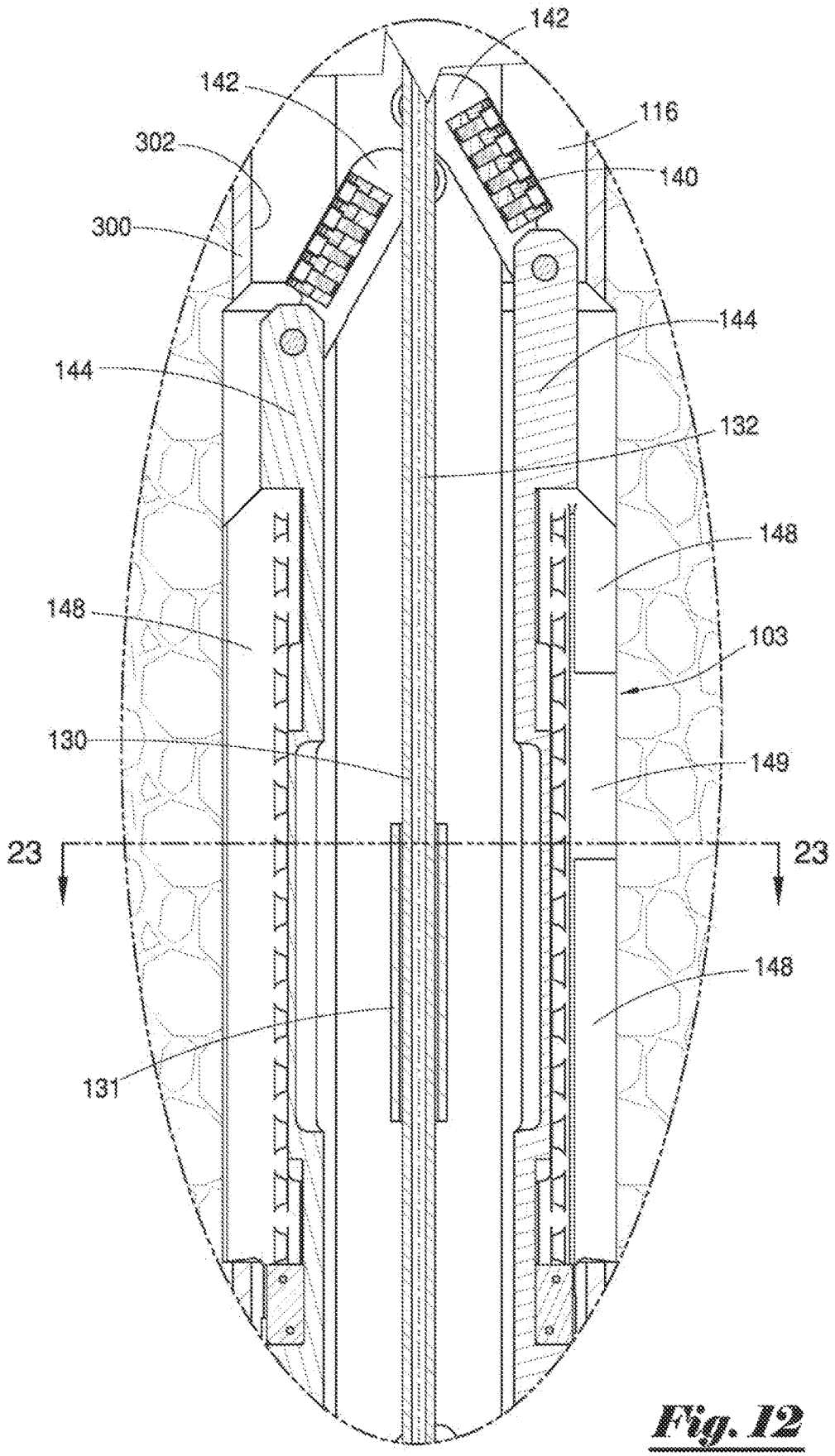
FIG. 12 is an enlarged cross-section view of the milling assembly of the section milling tool designated as detail 12 in FIG. 10B.
Figure 23:
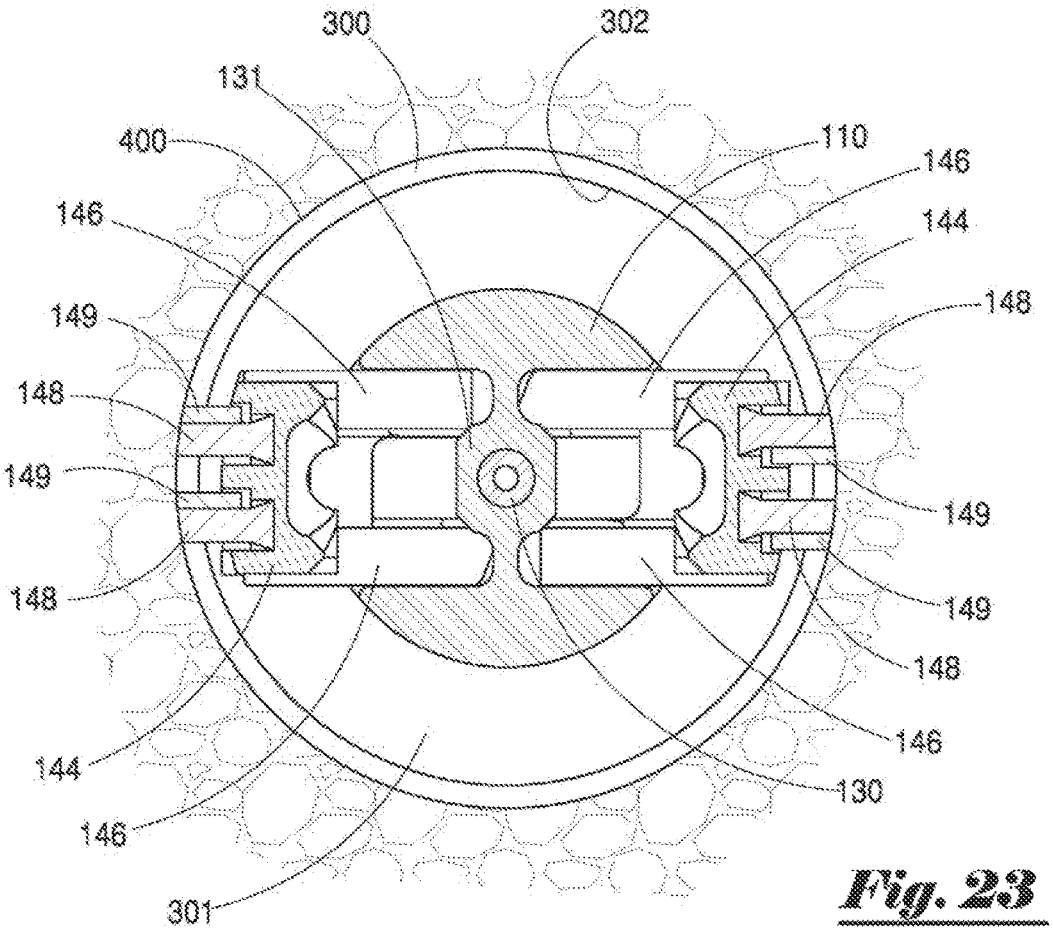
FIG. 23 is a horizontal cross-section view through the cutting window of the section milling tool of FIG. 1 taken from section 23 of FIG. 12 showing the position of the mill carrier and cutters during cutting of window in a liner pipe.

When extended through the mill window 116, the mill carriers 144 and the cutters 148 will be positioned in the central bore 301 in the annulus between the mill body 110 of the section milling tool 100 and the liner pipe string 300 to bear against the interior wall 302 of liner pipe string 300 where the window or opening is to be milled. Milling is then conducted by rotating the work string 200 to engage the cutters 148 with and cat through the interior wall 302 of liner pipe string 300 shown in FIG. 12 and in FIG. 23. The upper non-cutting stabilizer blade 149 and the lower non-cutting stabilizer pad 150 serves to prevent damage to an outer most casing while milling. Rotation of the work string 200 and the attached section milling tool 100 may be conducted by a rotary table 550 of the drilling rig 500 as shown in FIG. 17 or another rotation mechanism such as a top drive.

Cuttings created during milling am carried away by fluid circulating through the central bore 112 of the top sub 120 and mill body 110 of the section milling tool 100 and upward in the annulus between the mill body 110 and the liner pipe being milled.

Figure 8:
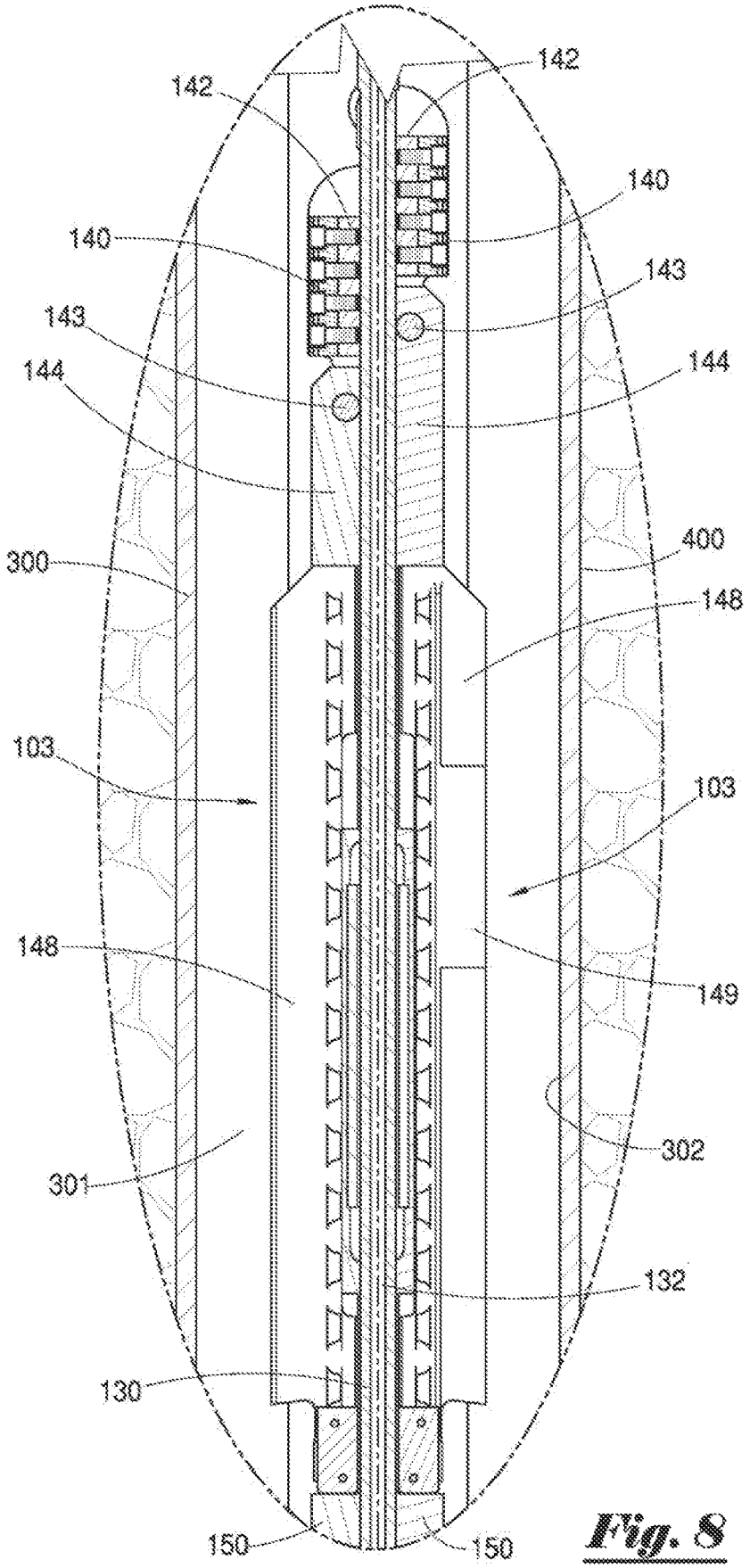
FIG. 8 is an enlarged cross-section view of the milling assembly of the section milling tool designated as detail 8 in FIG. 6B.

Once fluid pumping ceases, fluid in the pressure chamber 136 is evacuated though the fluid posts 135 in the lower piston stem 125*b* to relieve fluid pressure in the pressure chamber 136. This release of pressure in the pressure chamber 136 allows the release spring 124 to expand shifting the drive piston 126 downward to a downhole position. The downward movement of the drive piston 126 moves the attached flow tube 130 and the attached drive plunger 154 downward to a downhole position. The downward movement of the drive plunger 154 will then pivot the drive yoke links 151 upward and radially inward on crown pins 145 and stud pins 147 to pivot the upper follower links 142 and intermediate follower links 146 downward and radially inward to move the mill carriers 144 into the mill body 110 through the mill window 116 and return the mill carriers 144 to the position shown in FIG. 8. Returning the mill carriers 144 to the position shown in FIG. g will allow the section milling tool 100 to be repositioned or removed from the wellbore.

Figure 18:
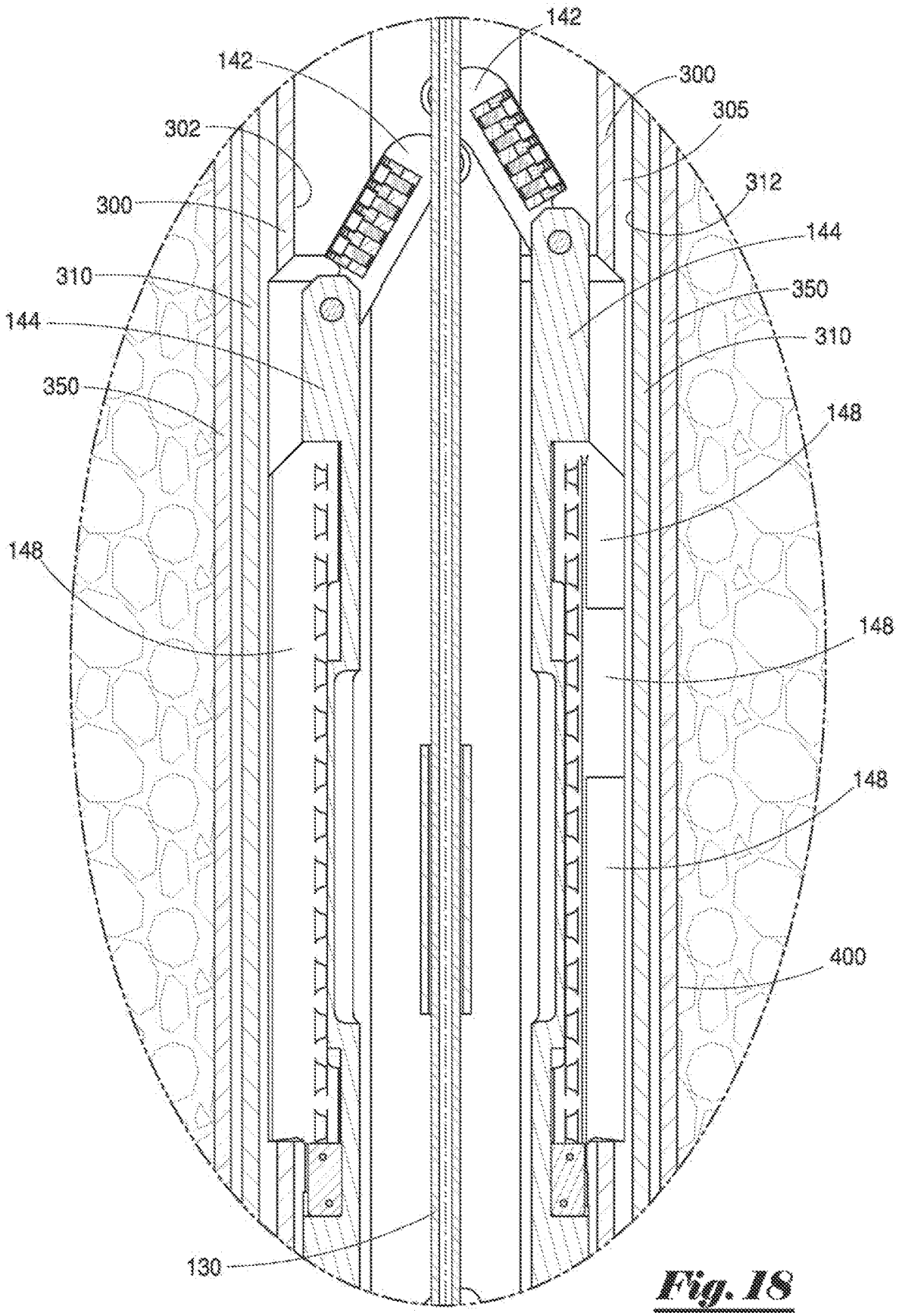
FIG. 18 is an enlarged cross-section view of the cutter assembly of the section mill of FIG. 1 utilized to mill through multiple pipe strings within wellbore.

FIG. 18 illustrates the section milling tool 100 utilized to mill through multiple strings of pipe. In FIG. 18, pipe string 300 is positioned within an outer interior pipe string 310 which is positioned within an exterior liner pipe string 350 lining wellbore 400. A window opening has been through pipe string 300 from its interior wall 302 into the annulus 305 between pipe string 300 and outer interior pipe string 310. The cutters 148 on mill carriers 144 of section milling tool 100 are shown positioned at the interior wall 312 of pipe string 310 for cutting a window opening through interior pipe string 310.

Figure 19:
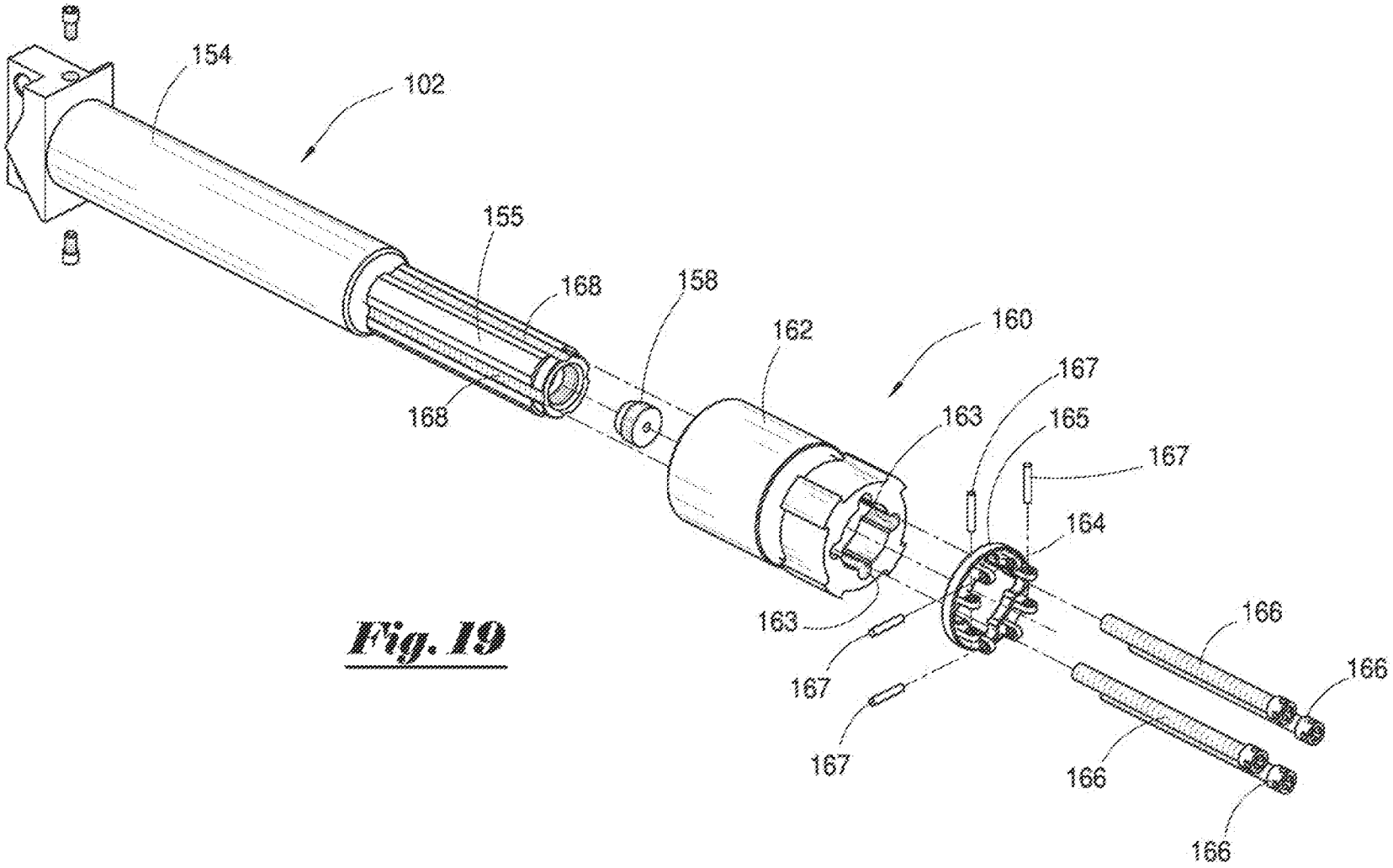
FIG. 19 is an exploded view of an expansion limiter utilized to limit the radial outward position of the mill carriers of the section milling tool shown in FIG. 1.

In some embodiments, an expansion limiter 160 may be provided with the plunger assembly 102 to limit the radial outward position of the mill carriers 144 and corresponding cutters 148 when the mill carriers 144 are deployed. Such an expansion limiter 160 is shown FIG. 2 and FIG. 3 and in more detail in FIGS. 19 and 20. In this embodiment the expansion limiter 160 includes a threadedly adjustable sleeve 162 slidably positioned around the elongated lower body section 155 of the drive plunger 154.

Sleeve 162 has threaded adjustment bares 163 that correspond with the bores 164 of an adjustment cap 165 and threaded groves 168 that extend along the lower body section 155 of the drive plunger 154. Threaded adjustment bolts 166, through bores sleeve bores 163, engage with the adjustment cap bores 164 and the threaded drive plunger grooves 168 to allow the sleeve 162 to be positioned at a desired location along the lower body section 155 of the drive plunger 154. When so positioned, the sleeve 162 may then be fixed in place on the lower body section 155 of the drive plunger 154 by pins 167, such as cotter pins, in the adjustment cap 165 or by set screws.

Figure 20:
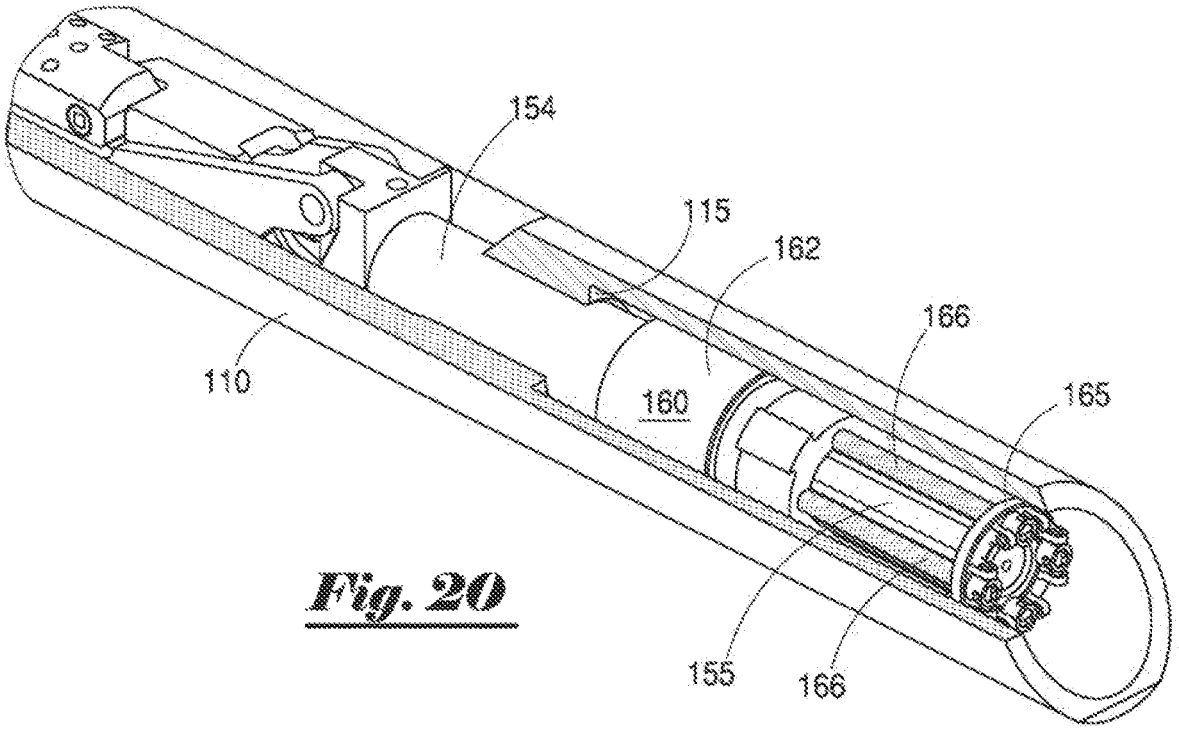
FIG. 20 is a partial longitudinal cross-section view of the section milling tool shown in FIG. 1 showing the drive plunger with the expansion limiter shown in FIG. 19.

A shoulder 115 in the lower end of mill body 110, shown in FIG. 20, is provided to engage with sleeve 162 as it moves upward with de drive plunger 154 in response to the upward movement of the drive piston 126 and the attached flow tube 130. The position of the sleeve 162 on the lower body section 155 of the drive plunger 154 when it engages the mill body shoulder 115 will limit the upward movement of the drive plunger 154 and correspondingly, the downward and radially outward movement of the drive yoke links 151 and the radial outward movement of the mill carriers 144. Fixing the sleeve 162 at a desired position on the lower body section 155 of the drive plunger 154 by the adjustment bolts will limit the cutting range of the mill cutter 146 to a desired maximum or a desired minimum which serves to avoid overcuts in situations where there are additional outer pipe strings.

Figure 21:
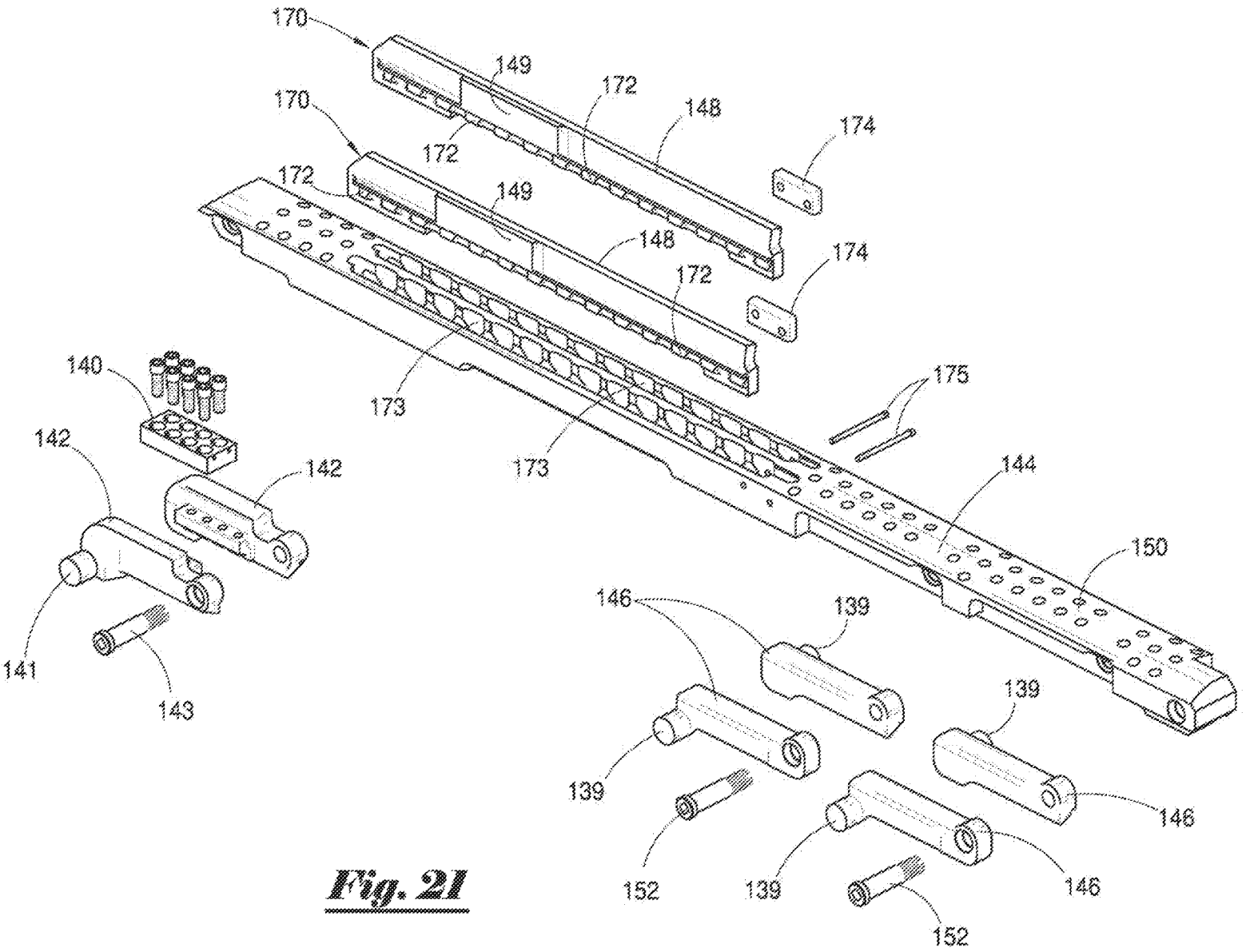
FIG. 21 is an exploded view of a mill carrier of the section milling tool of FIG. 1 having an embodiment of a detachable and interchangeable cutter shoe.

In some embodiments of the section milling tool, the cutters 148 and stabilizer blades 149 may be mounted on interchangeable releasably attachable and detachable cutter shoe module. Use of a cotter shoe module that is releasably attachable and detachable from the mill carrier 144 will facilitate the replacement of worn cutters, even in the field, which will lead to less downtime and at reduction in the cost of milling. One embodiment of a releasably attachable and detachable cutter shoe module 170 is shown in FIG. 21. Cutter shoe module 170 has a longitudinally extending army of cutters 148 and stabilizer blades 149 and an array of dovetailed slides 172 that slide into a corresponding army of dovetailed grooves 173 in the mill carrier 144. A releasably attachable retainer block 174 secured by removable threaded pins or bolts 175 holds the cutter shoe module 170 in place on the mill carrier 144. Multiple shoe modules 170 may be used on each mill carrier 144.

Figures 22, 24:
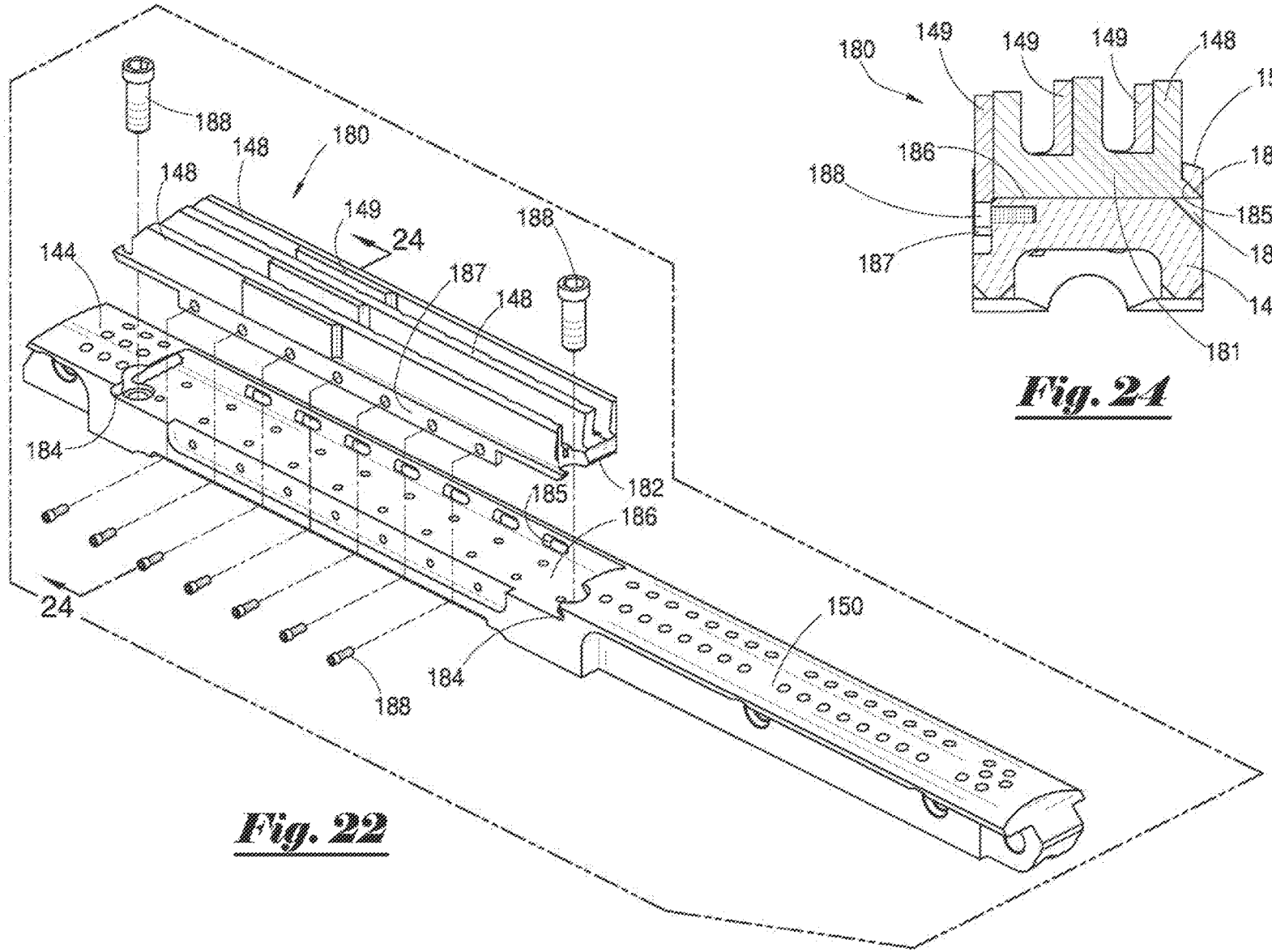
FIG. 22 is an exploded view of a mill carrier having another embodiment of a detachable and interchangeable cutter shoe.
FIG. 24 is a horizontal cross-section view through the embodiment of the detachable and interchangeable cutter shoe taken from section 24 of FIG. 22.

FIGS. 22 and 24 show another embodiment of a releasably attachable and detachable cutter shoe module 180. Cutter shoe module 180 is provided with one or more rows of cutters 148 with stabilizer blades 149 mounted on a base 181. The base 181 has beveled dovetailed end. 182 and attachment tabs 183. The base 181 of cutter shoe module 180 slides into a recess 186 on the mill carrier 144. Recess 186 has beveled dovetail grooves 184 and the attachment slows 185 that receive, respectively, the beveled dovetailed ends 182 and attachment tabs 183 of the base 181. An attachment plate 187 mounted on one edge of the base 181 of the cutter module 180 receives pins or bolts 188 to attach and hold the cutter module 180 in place a the edge of the mill carrier 144. Additional attachment bolts 188 may be used to attach the cutter shoe module 180 at the top of the mill carrier 144.

It is thought that the section milling tool 100 presented herein and its attendant advantages will be understood from the foregoing description. It will be apparent that various changes may be made in the form, construction and arrangement of the parts of the section milling tool 100 without departing from the spirit and scope of the invention or sacrificing all of its material advantages, the form described and illustrated are merely an example embodiment of the invention.

The invention claimed is:

1. A section milling tool comprising:

(a) a body having a translatable piston;

(b) a pressure chamber within said body whereby fluid pressure generated in said pressure chamber translates said translatable piston;

(c) a translatable flow tube having an upper end attached to said translatable piston and a lower end attached to a translatable drive plunger;

(d) a mill carrier; and (e) a drive yoke link pivotally attaching said mill carrier to said translatable drive plunger.

2. The section milling tool recited in claim 1 wherein said translatable piston, said flow tube, and said translatable drive plunger move in response to fluid pressure changes in said pressure chamber.

3. The section milling tool recited in claim 2 wherein said mill carrier moves radially outward and inward with respect to said mill body in response to movement of said translatable piston, said flow tube, and said translatable drive plunger.

4. The section milling tool recited in claim 3 wherein said translatable piston is biased toward a stationary thimble by a compression spring.

5. The section milling tool recited in claim 4 further comprising an expansion limiter whereby radially outward movement of said mill carrier is selectively limited.

6. The section milling tool recited in claim 5 further comprising a cutter mounted on a cutter shoe module, said cutter shoe module detachably mounted to said mill carrier.

7. The section milling tool recited in claim 6 wherein said mill carrier has a stabilizer pad.

8. The section milling tool recited in claim 7 wherein said cutter includes a stabilizer blade.

9. A section milling tool comprising:

(a) a body having a translatable piston and a stationary thimble;

(b) a pressure chamber within said body between said translatable piston and said stationary thimble;

(c) a translatable flow tube having an upper end attached to said piston and a lower end attached to a translatable drive plunger, said flow tube slidably inserted through a central bore in said stationary thimble whereby said translatable piston, said flow tube, and said translatable drive plunger move in response to fluid pressure changes in said pressure chamber:

(d) a mill carrier, (e) a drive yoke link pivotally attaching said mill carrier to said translatable drive plunger; and (f) a cutter attached to said mill carrier.

10. The section milling tool recited in claim 9 wherein changes in fluid pressure in said pressure chamber moves said piston and said attached flow tube to radially extend and retract said mill carrier from said body.

11. The section milling tool recited in claim 10 wherein said translatable piston is biased toward said stationary thimble by a compression spring.

12. The section milling tool recited in claim 10 further comprising fluid ports in fluid communication with said pressure chamber.

13. The section milling tool recited in claim 10 further comprising an expansion limiter whereby radially outward movement of said mill carrier is selectively limited.

14. The section milling tool recited in claim 13 wherein said expansion limiter is comprised of:

(a) a sleeve slidably positionable at a desired location around said drive plunger; and (b) a shoulder within said body, said shoulder restraining upward movement of said drive plunger.

15. The section milling tool recited in claim 10 wherein said cutter is mounted on a cutter shoe module, said cutter shoe module detachably mounted to said mill carrier.

16. The section milling tool recited in claim 15 wherein said cutter shoe module has a dovetailed slide that slides into a corresponding dovetailed groove in said mill carrier.

* * * * *